United States Patent [19]

Ogikubo

[11] 4,272,652

[45] Jun. 9, 1981

[54] MOVING COIL TYPE STEREOPHONIC PICKUP CARTRIDGE

[75] Inventor: Masaru Ogikubo, Kokubunji, Japan

[73] Assignee: Nippon Atsudenki K.K., Mitaka, Japan

[21] Appl. No.: 41,918

[22] Filed: May 23, 1979

[30] Foreign Application Priority Data

May 25, 1978 [JP] Japan ..... 53-62450
Apr. 16, 1979 [JP] Japan ..... 54-45671

[51] Int. Cl.[3] ..... H04R 9/16
[52] U.S. Cl. ..... 369/139; 369/149
[58] Field of Search ..... 179/100.41 D, 100.41 K; 274/37

[56] References Cited

U.S. PATENT DOCUMENTS

| | | | |
|---|---|---|---|
| 3,294,405 | 12/1966 | Pritchard | 179/100.41 K |
| 3,679,843 | 7/1972 | Cho | 179/100.41 K |
| 3,729,596 | 4/1973 | Toth | 179/100.41 K |
| 3,761,647 | 9/1973 | Nemoto | 179/100.41 K |
| 3,878,342 | 4/1975 | Madsen | 179/100.41 D |
| 4,124,783 | 11/1978 | Nemoto | 179/100.41 D |

FOREIGN PATENT DOCUMENTS

| | | | |
|---|---|---|---|
| 1135675 | 8/1962 | Fed. Rep. of Germany | 179/100.41 K |
| 1241633 | 6/1967 | Fed. Rep. of Germany | 179/100.41 K |
| 1000035 | 8/1965 | United Kingdom | 179/100.41 K |

*Primary Examiner*—Daryl W. Cook
*Assistant Examiner*—Alan Faber
*Attorney, Agent, or Firm*—Quaintance, Murphy & Richardson

[57] ABSTRACT

A moving coil type stereophonic pickup cartridge is disclosed wherein a pair of magnetic air gaps are established corresponding to the walls of the sound groove of a 45°–45° stereophonic record and arranged such that the orientation of magnetic flux in the air gaps projects orthogonally to each other. The two magnetic air gaps are arranged on the right and the left of a cantilever fulcrum respectively. A coil is arranged within each of the gaps, each coil having a winding axis generally parallel to the axis direction of the cantilever. Each coil moves within its associated magnetic air gap integrally with the cantilever, thereby developing high output signals.

11 Claims, 19 Drawing Figures

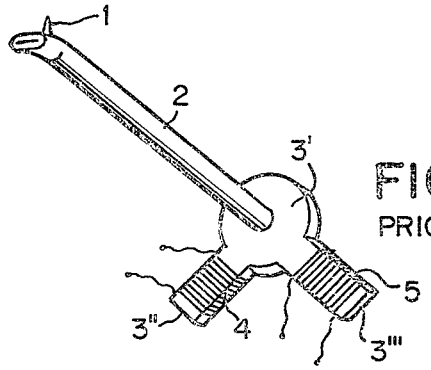
FIG.1B
PRIOR ART
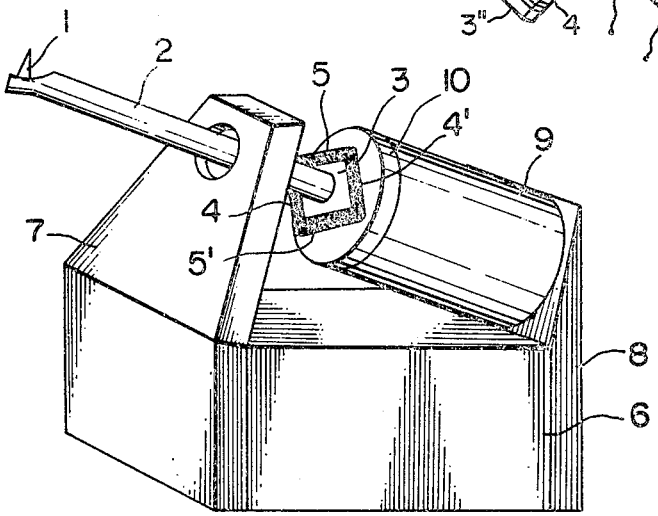
FIG.1A
PRIOR ART
FIG. 2A
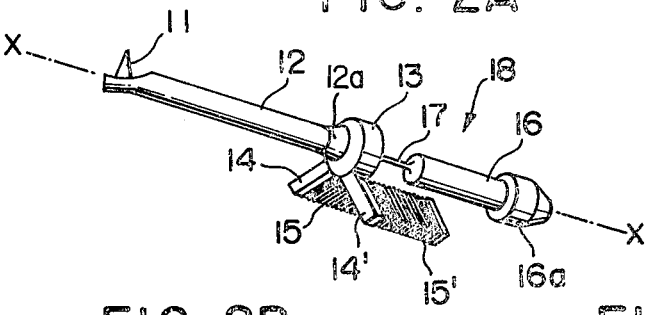
FIG. 2B
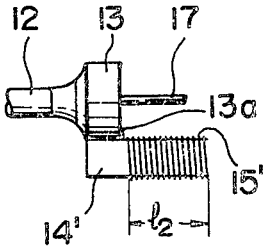
FIG. 2C
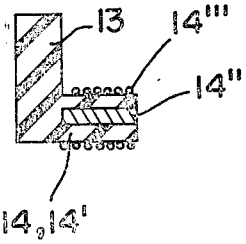

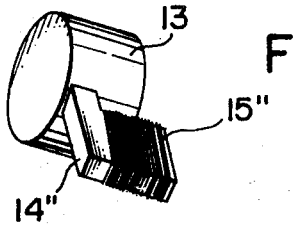
FIG. 5A
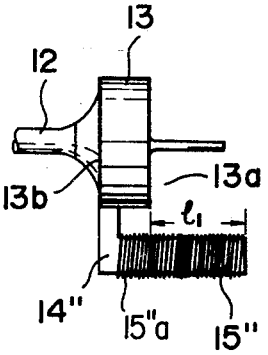
FIG. 5B
FIG. 6A
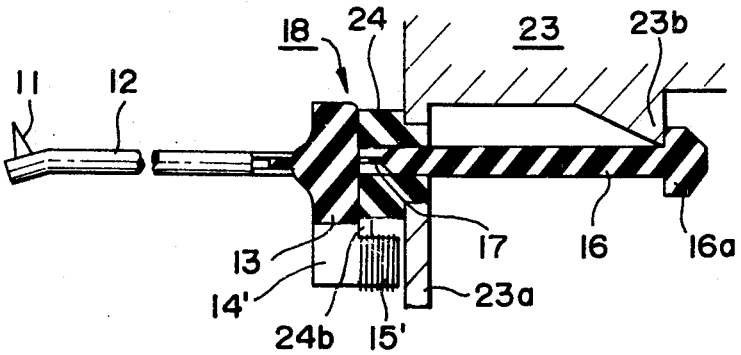
FIG. 6B
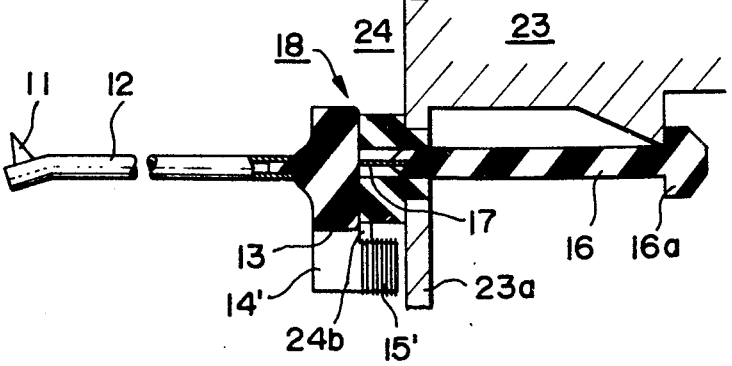

MOVING COIL TYPE STEREOPHONIC PICKUP CARTRIDGE

BACKGROUND OF THE INVENTION

1. Field of the Invention

This invention relates to a stereophonic pickup cartridge of the moving coil type wherein coils are mounted on the rear part of a cantilever having a stylus attached to the front end thereof and wherein the coils are arranged within a magnetic field in a magnetic air gap.

In a pickup cartridge of this type, electric signals are generated in coils which are installed on an end of the cantilever opposite the stylus. The coils move with the stylus vibration within air gaps of a magnetic circuit which is formed by a magnet and yokes. The conversion of a stylus vibration into an electrical signal is direct while the electrical impedance of the cartridge is low scarcely varying in a region from low to high audio frequencies. Accordingly, the vibration of the stylus is proportionally changed to an electric signal, and a uniform sound reproduction of very high fidelity is possible. The pickup cartridge is therefore typically used with high-quality sound reproduction equipment.

2. Description of the Prior Art

A moving coil type stereophonic pickup cartridge which has heretofore been used extensively is shown in FIG. 1A of the accompanying drawings. A stylus 1 is mounted on the front end of a cantilever 2, while a square magnetic plate 3 is mounted orthogonally on the rear supporting end part of the cantilever 2. Two sets of coils 4, 4' and 5, 5' which intersect orthogonally to each other are wound on the magnetic plate 3.

Numeral 6 designates a magnet. The lower part of an angular front yoke 7 is attached to one end of the magnet 6. At the other end of the magnet 6, a rear yoke 8 is attached which is shorter than the front yoke 7. A cylindrical holder yoke 9 has its base part fixed in a manner to extend from the upper end of the rear yoke 8 towards the magnetic plate 3. A gap is formed between the holder yoke 9 and the magnetic plate 3. A damper 10 which is made of soft rubber, or the like, is arranged between the magnetic plate 3 and the holder yoke 9 so as to damp the vibration of the stylus 1.

In the cartridge thus constructed, the magnetic flux of the magnetic 6 can be said to flow through the front yoke 7 and the rear yoke 8 at both ends of the magnet 6 and the holder yoke 9. An electric current is induced in the coils 4, 4' and 5, 5' by movement of the coils in the magnetic field existing between front yoke 7 and holder yoke 9. Ideally, when one set of coils 4 and 4' interacts with the magnetic flux, the other set of coils 5 and 5' does not so that the respective signals of the right and left channels are detected independently. A further description of cartridges of this type can be found in British Pat. No. 1,000,035.

However, it has been found that this cartridge exhibits a low output level, thus necessitating a special amplifier or a step-up transformer. In general, the cartridge exhibits low trackability or compliance. In the fabrication of such a cartridge, many difficulties are involved in the winding of the coils, the terminal processing of coil leads, etc. These characteristics have hindered the commercial acceptance of such a cartridge.

With a pickup cartridge of the construction illustrated in FIG. 1A a higher output can be obtained by narrowing the gap between the holder yoke 9 and the front yoke 7 thus intensifying the magnetic field. This magnetic field enhancement is restricted, however, because the damper 10 exists within the gap.

Further, since the two independent signals of the right and left channels are obtained by arranging the two sets of coils intersecting orthogonally to each other within a single magnetic field in an identical direction, the independency of the two signals is determined by only the winding directions of the coils. This leads to crosstalk problems which are difficult to correct.

With respect to frequency characteristics, a short cantilever is generally thought to be advantageous because the vibrating system can be constructed of a lighter mass and has a lower moment of inertia. The shortening of the cantilever structure shown in FIG. 1 is restricted by the hindrance of the tip part of the front yoke 7.

Another example of the prior art is to be found in U.S. Pat. No. 3,679,843 wherein the square magnetic plate 3 illustrated in FIG. 1A is replaced by a round magnetic plate 3' illustrated in FIG. 1B having a pair of extensions 3'' and 3'''. A single coil 4 and 5 is wound on each of the extensions 3'' and 3''' respectively. The stylus subassembly thus formed is then positioned in a magnetic circuit nearly identical to that previously described. The axis of the two coils 4 and 5 remains orthogonal to each other which the coils are positioned in a single common magnetic field similar to that previously discussed. The use of a single common magnetic plate 3 continues to introduce unwanted crosstalk which is difficult to further reduce. Another example of prior art is U.S. Pat. No. 3,299,219.

SUMMARY OF THE INVENTION

A cartridge according to the present invention has a construction wherein a pair of magnetic air gaps are established corresponding to the walls of a sound groove of 45°—45° stereophonic record and arranged such that the orientation of magnetic flux in the air gaps projects orthogonally to each other. The magnetic air gaps are individually formed on the right and left of a supporting portion of a cantilever. Coils whose winding axes extend generally parallel to the axis of the cantilever are wound on coil bobbins and the coil bobbins are secured integrally to the cantilever within the gaps.

One feature provided by this invention is a pickup cartridge wherein the gaps of a pair of magnetic circuits are individually formed on the right and the left of a supporting portion of a cantilever in such a manner that the directions of magnetic flux with the two gaps is orthogonal to each other.

Another feature provided by this invention is a pickup cartridge wherein a pair of coils which are independent of each other and whose winding axes extend generally parallel to the axis of the cantilever are respectively disposed integrally with the cantilever inside the pair of magnetic air gaps, thereby ensuring the independency and equality of two signals induced in the pair of coils.

One advantage provided by this invention is the exclusion of the damper from the magnetic air gap so that the gaps can be narrowed, whereby the magnetic efficiency is satisfactorily raised in order to attain high electrical output signals.

Another advantage provided by this invention is the elimination of hindrance of the front yoke whereby the cantilever can be made as short as possible, thereby improving frequency characteristics.

Yet another advantage provided by this invention is the independent mechanized winding of the coils onto coil bobbins separate from the stylus sub-assembly whereby the winding operation is conspicuously simplified attaining a lower cost mass-productivity.

The features provided by this invention permit the easy exchange of a stylus in spite of the cartridge being of the moving coil type.

A preferred embodiment of this invention has the advantage of permitting the exchange of the stylus by merely the operation of removing a stylus knob from the main body of the cartridge.

The features of this invention permit the construction of a pickup cartridge wherein the stylus is appropriately located relative to the stylus knob and is prevented from turning.

Another feature of a preferred embodiment of this invention is a pickup cartridge wherein the leads of the coils are immediately wired to a sub-terminal means thereby preventing the vibration of the leads and the possible resultant fatigue failure thereof.

Yet another feature of this invention is a stylus and cantilever which is supported by a supporter having a reduced-diameter portion defining the fulcrum of vibration.

Still another feature of this invention is providing a supporter to which the cantilever is attached which can be easily engaged with the stylus knob.

Other features and advantages of this invention will become apparent from the following detailed description of concrete examples thereof taken with reference to the accompanying drawings.

BRIEF DESCRIPTION OF THE DRAWINGS

FIG. 1A is a perspective view showing an example of a prior-art stereophonic pickup cartridge of the moving coil type.

FIG. 1B is a perspective view of an alternate stylus sub-assembly of the prior art.

FIG. 2A is a perspective view of a stylus sub-assembly according to this invention.

FIG. 2B is a side view of the stylus sub-assembly of FIG. 2A.

FIG. 2C is a sectional view of a part of the stylus sub-assembly shown in FIGS. 2A and 2B.

FIG. 5A is a perspective view showing another embodiment of a coil bobbin according to this invention.

FIG. 5B is a side view of the coil bobbin shown in FIG. 5A.

FIGS. 6A and 6B are sectional views, each showing another embodiment of the stylus sub-assembly according to this invention.

PREFERRED EMBODIMENTS OF THE INVENTION

Figure 3:
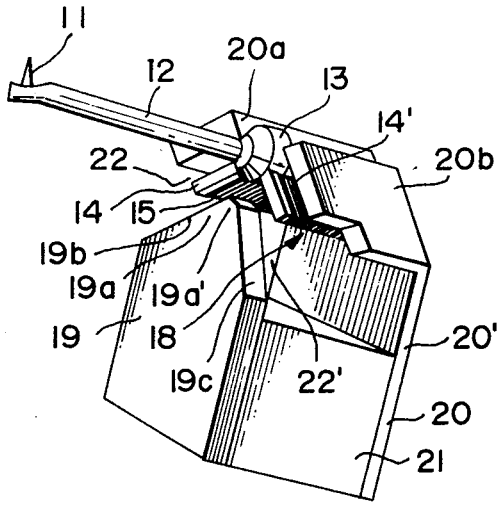
FIG. 3 is a perspective view of an embodiment shown in the state in which the stylus sub-assembly in FIG. 2A is assembled between a front yoke and a rear yoke.

An embodiment of this invention will be described with reference to FIGS. 2A, 2B, 2C, 3 and 4. Numeral 11 designates a stylus which is mounted on the front end of a cantilever 12. The base part 12a of the cantilver 12 has a larger diameter, and is provided with a supporting portion 13. Two coil bobbins ($\mu$ plates) 14 and 14' which are made of a high permeability material and whose cross-sectional shapes are square are attached to the supporting portion 13 in such a manner that they define an angle of 90° therebetween and that they are respectively held generally parallel with the extension line of the axis X—X of the cantilever 12. Coils 15 and 15' are respectively wound on the coil bobbins 14 and 14' in such a manner that their winding axes are approximately parallel to the axis of the cantilever 12. Numeral 16 indicates a supporter, and numeral 17 a tension wire. These parts are used for supporting the entire stylus sub-assembly 18. Although the tension wire 17 may be made a member separate from the supporter 16, it may be formed in a known manner of polypropylene or other resin as an integral molding with the supporter 16.

The coil bobbins 14 and 14' and the coils 15 and 15' may be constructed so that the coil bobbins are formed integrally with the supporting portion 13 and so that cavities 14'' are formed in the coil bobbins 14 and 14'. Pieces of a high permeability material 14''' are inserted in the cavities 14'' and the coils 15 and 15' are wound on the coil bobbins 14 and 14' as shown in FIG. 2C.

Figure 4:
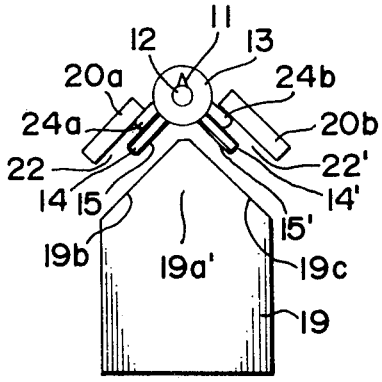
FIG. 4 is a front elevation of the embodiment of FIG. 3 viewed from the left.

FIGS. 3 and 4 show the position in which the stylus sub-assembly 18 is disposed between a front yoke 19 and a rear yoke 20. Both the front yoke 19 and the rear yoke 20 are made from flat bodies or plates. They have a fixed spacing therebetween, and a magnet 21 for magnetizing the yokes 19 and 20 is interposed therebetween.

That end face 19a of the front yoke 19 which is remote from the magnet 21 is substantially in such a triangular shape that a central part 19a' protrudes and that the extension lines of end faces 19b and 19c intersect at an angle of 90°. On the other hand, that end 20' of the rear yoke 20 which is remote from the magnet 21 is branched into two branch parts 20a and 20b, each in the form of plates extending to the sides of the end faces 19b and 19c of the front yoke 19, respectively. The extension lines of the branch parts 20a and 20b of the rear yoke 20 intersect at an angle of 90° with each other. The end face 19b of the front yoke 19 and the branch part 20a of the rear yoke 20, and the end face 19c of the front yoke 19 and the branch part 20b of the rear yoke 20 are respectively in parallel relations. Magnetic air gaps 22 and 22' are thus defined between the respective parts and the gaps correspond to the sides of a sound groove of a 45°—45° stereophonic record. The directions of magnetic flux in the respective gaps 22 and 22' have an angle of 90° to each other with the center at the axis of the cantilever 12.

One of the magnetic circuits in this assembly is formed of the magnet 21, the front yoke 19, the end fact 19*b* of the front yoke 19, the gap 22, the branch part 20*a* of the rear yoke 20, the rear yoke 20, and the magnet 21. The other magnetic circuit is formed of the magnet 21, the front yoke 19, the end face 19*c* of the front yoke 19, the gap 22', the branch part 20*b* of the rear yoke 20, the rear yoke 20, and the magnet 21. The coil 15 mounted on the cantilever 12 is arranged within the gap 22 of the one magnetic circuit, while the coil 15' mounted on the cantilever 12 is arranged within the gap 22' of the other magnetic circuit.

With the stylus sub-assembly 18 thus constructed, when the cantilever 12 vibrates as the stylus 11 vibrates according to a moving record groove, the coils 15 and 15' move in the respective gaps 22 and 22' together with the coil bobbins 14 and 14' attached to the base part of the cantilever 12. Since the magnet 21 is interposed between the front yoke 19 and the rear yoke 20 as stated previously, magnetic flux flows through the front yoke 19 and the rear yoke 20 from both the ends of the magnet 21 and establishes magnetic fields within the gaps 22 and 22' at the opposing end parts of the yokes 19 and 20. Accordingly, stereophonic signals are generated in the coils 15 and 15' which vibrate in the magnetic fields.

Although the coil bobbins 14 and 14' attached to the supporting portion 13 in the illustration of FIGS. 2A through 2C are of square cross-section, they are not restricted to that shape but may be in any other form. For example, the coil bobbins can be circular in cross-section.

FIGS. 5A and 5B illustrate an example in a different form. In this case, the coil bobbin 14'' is L-shaped. The base end of the coil bobbin 14'' is attached to the supporting portion 13 at the base part of the cantilever 12, and the coil 15'' is wound on a bent part parallel to the axis of the cantilever 12 of the coil bobbin 14''. Although another coil bobbin is omitted from the illustration of FIGS. 5A and 5B, it is needless to say that this structure also has two coil bobbins.

In the structure of FIG. 2B, the coil 15' must be started winding on the coil bobbin 14' from the side of the end 13*a* of the supporting portion 13. In contrast, when the coil bobbin 14'' is L-shaped, the winding starting end 15''*a* of the coil 15'' is located nearer to the end 13*b* of the supporting portion 13 beyond the end 13*a* thereof as illustrated in FIG. 5B. Thus, the length $l_1$ by which the coil bobbin 14'' protrudes rearwardly of the cantilever 12 beyond the end 13*a* of the supporting portion 13 can be made smaller than the corresponding length $l_2$ in FIG. 2B. This permits the mass to be concentrated in the vicinity of the supporting portion 13 which results in advantageous vibration characteristics for the stylus sub-assembly and cartridge.

FIG. 6A shows the position in which the stylus sub-assembly 18 is mounted on a stylus knob 23. At the front edge of the stylus knob 23, a protuberance 23*a* having a plate-like section is formed. The supporter 16 of the stylus sub-assembly 18 penetrates through the protuberance 23*a*, and extends in the interior of the stylus knob 23. Inside the stylus knob 23, there is formed an engaging portion 23*b* having a triangular section, with which the base part 16*a* of the supporter 16 having a larger diameter is engaged.

Numeral 24 designates a damper which is interposed between the supporting portion 13 and the protuberance 23*a* under a somewhat compressed condition surrounding the tension wire 17. The damper 24 is fabricated of a rubbery material or the like, and is substantially cylindrical. At parts of the damper 24, very small protrusions 24*a* and 24*b* are provided which extend in directions orthogonal to each other. These protrusions 24*a* and 24*b* are adapted to lie outside the coil bobbins 14 and 14' having the coils 15 and 15' wound thereon when the damper 24 is interposed between the supporting portion 13 and the protuberance 23*a* of the stylus knob 23. Thus, when the stylus sub-assembly 18 is mounted on the stylus knob 23, the protrusions 24*a*, 24*b* are respectively situated between the coils 15, 15' and the branch parts 20*a*, 20*b* of the yoke 20 as shown in FIG. 4 and properly locate and position the coils 15, 15' within the gaps 22, 22'. The protrusions 24*a*, 24*b* of the damper 24 have elastic forces to the extent that they have no influence on the movements of the coils 15, 15' within the gaps 22, 22'.

The vibrational fulcrum of the cantilever 12 lies on the tension wire 17. As shown in FIG. 6A, the supporting portion 13, the tension wire 17 and the supporter 16 may be integrally constructed. Alternatively, it is allowed to form the supporting portion 13, the tension wire 17 and the supporter 16 as separate members and then couple them to one another with a binder or the like as shown in FIG. 6B.

Figure 7A:
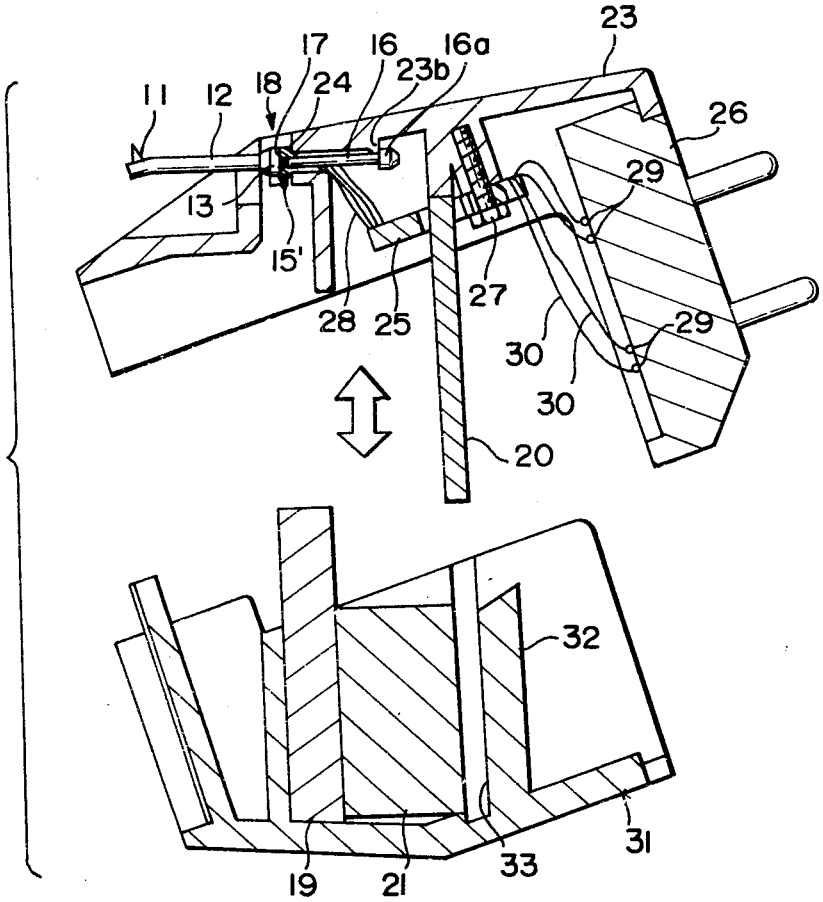
FIGS. 7A and 7B are sectional views of the whole structure of an embodiment of a stereophonic cartridge of this invention, FIG. 7A showing the detached state of this embodiment.
Figure 7B:
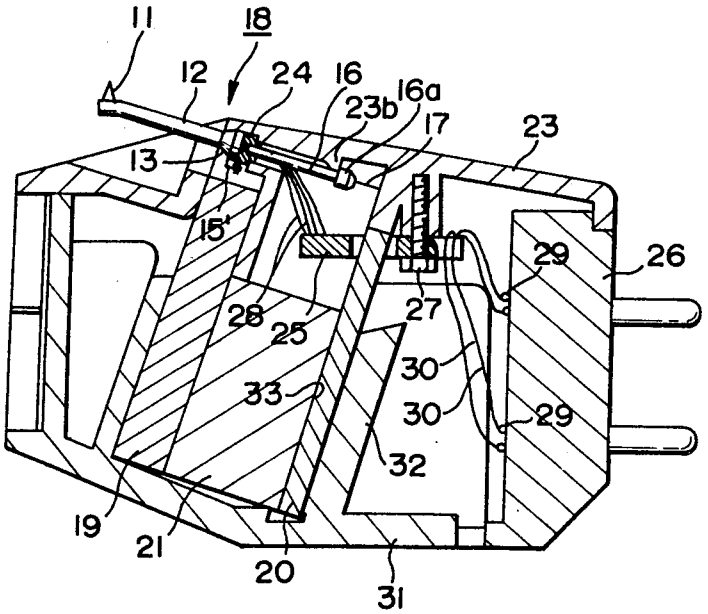

FIGS. 7A and 7B show a construction in which the sylus know 23 with the vibrating portion 18 mounted thereon as shown in FIG. 6A is detachable. Referring to FIG. 7A, on the side of the stylus knob 23, the rear yoke 20, a printed circuit board 25 employed as a subterminal means, a terminal plate 26, etc., are mounted in addition to the stylus sub-assembly 18. Shown at 27 is a screw for mounting the circuit board.

Leads 28 from coils 15 and 15' are connected to the printed circuit board 25 employed as a subterminal means. The printed circuit board 25 and terminal means 29 embeded in the terminal plate 26 are connected by electric wires 30 having a sufficient size. The mounting of the terminal plate 26 on the stylus knob 23 is done in such a way that a projecting strip (not shown) on a side part of the terminal plate 26 is snugly fitted in a groove (not shown) provided in the stylus knob 23.

The stylus knob 23 is mounted on main body 31 by a snug friction fit. This structure is such that the rear yoke 20 disposed on the side of the stylus knob 23 is closely fitted in an interspace or slot 33 which is defined between a projecting piece 32 of the body 31 and the rear surface of the magnet 21 mounted on the side of the body 31 together with the front yoke 19.

In FIG. 7A, the lead 28 penetrates through the damper 24 so as to connect to the subterminal 25. Since the lead 28 is supported by the damper 24, the lead does not slacken and it will not be cut by the vibration of the cantilever etc.

The manner in which the body 31 and the stylus knob 23 are separated is illustrated in FIG. 7A by the arrow showing the direction of separating motion. FIG. 7B illustrates the same cartride when the body 31 and knob 23 are joined together.

This invention constructed as above stated has the effects described hereunder. The pair of magnetic air gaps are arranged to correspond to the walls of the sound groove of a 45°–45° stereophonic record so that the directions of magnetic flux intersect orthogonally to each other. Only the coils wound on the coil bobbins are arranged in the gaps, so that the gaps can be narrowed which in turn increase the output currents induced in the coils. If the windings on the coil bobbins are made flat, the gaps can be made still narrower and higher outputs can be obtained as only the coil bobbins and the cois exist in the gaps.

Further, according to this invention, the gaps of the pair of magnetic circuits are arranged on the right and the left of the cantilever and the cantilever does not penetrate through the front yoke so that the cantilever can be made short. Since the cantilever does not penetrate through either of the yokes, the stylus can be easily exchanged merely by removing the stylus knob.

Further, the coil bobbins are respectively disposed along a line parallel to the axis of the cantilever. The coils of the right and left channels are wound on the respective coil bobbins independently of each other, so that whether the coil winding is skillful or unskillful does not seriously affect the performance, thus the winding operation can be conspicuously simplified.

Since the coils are prevented from turning by means of the protrusions of the damper and are fixedly located within the gaps, the postures of the coils in the gaps can be made uniform. Moreover, the correct location of the stylus relative to the stylus knob can be assured. Since the leads of the coils can be immediately wired to the subterminal means, the vibrations of the leads and the disconnections of the leads due to the vibrations can be prevented.

In FIG. 7(A), the lead 28 penetrates through the damper 24 to connect to the subterminal 25. Since the lead 28 is supported by the damper 24, the lead does not slacken and it will not be cut by the vibration of the cantilever etc.

Figure 8:
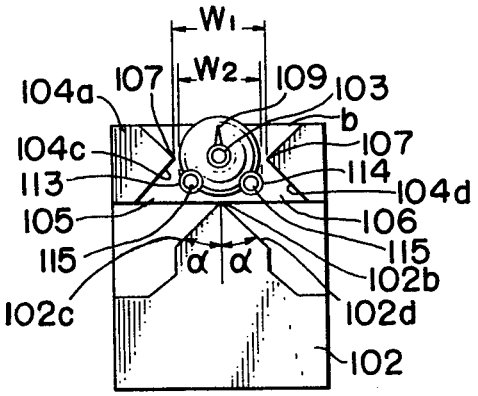
FIG. 8 is a front elevation view of another embodiment according to the present invention in which the stylus sub-assembly is positioned between a front yoke and a rear yoke.
Figure 9:
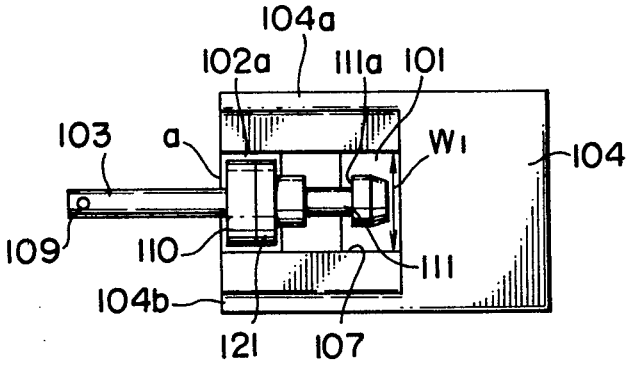
FIG. 9 is a top view of the embodiment shown in FIG. 8.
Figure 10:
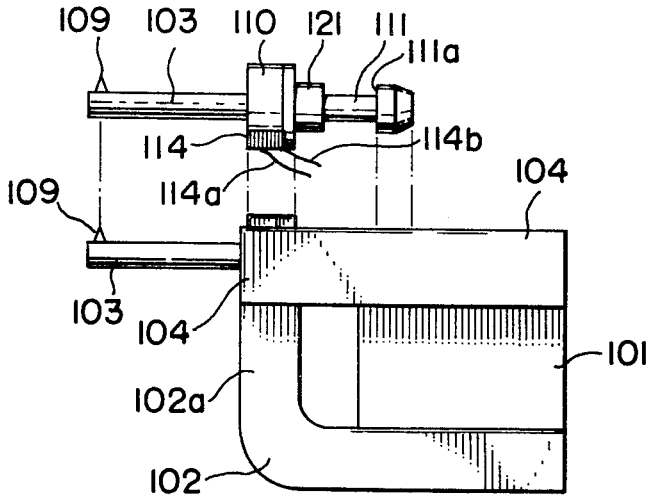
FIG. 10 is a side view of the embodiment in FIG. 8 showing the states in which the stylus sub-assembly is attached to or detached from the yokes.

FIGS. 8 through 10 show another embodiment according to the present invention. In this embodiment, a stylus can be exchanged by taking off only a stylus sub-assembly consisting of a stylus, a cantilever, moving coils etc. together with a knob.

In FIGS. 8 through 10, a front yoke 102, magnetically connected to a permanent magnet 101, is arranged within an imaginary plane which perpendicularly intersects the axis of the cantilever. On the front portion 102*a* of the front yoke, to the sides of the cantilever 103, a pair of planes 102*c* and 102*d* are formed which correspond to the walls of a sound groove of a 45°—45° system record. The pair of planes inclined so as to form angle $\alpha$ respectively with respect to an imaginarily perpendicular plane $\beta$ including the cantilever axis. The most desirable angle $\alpha$ is 45°, but it is not restrictive and small deviation from 45° does not given any grave effect on the performance of the cartridge.

On the rear yoke 104 connected magnetically to the permanent magnet, a pair of branched portions 104*a* and 104*b* are provided which extend toward the portion 102*a* of the front yoke along the cantilever axis 103. On a pair of the branched portions 104*a* and 104*b* a pair of planes 104*c* and 104*d* are formed which are opposed to the planes 102*c* and 102*d* of the front yoke 102 respectively.

The magnetic gaps 105 and 106 are thus created between the planes 102*c*, 102*d* of the front yoke 102 and the planes 104*c*, 104*d* of the rear yoke. The gap 105 is constituted by the planes 102*c*, 104*c* and the gap 106 is constituted by the planes 102*d*, 104*d*. As mentioned above, the planes 102*c* and 102*d* form the angle $\alpha$ with respect to the imaginarily perpendicular plane $\beta$ including the cantilever respectively.

The direction of the magnetic flux within the gap 104 and that of the magnetic flux within the gap 106 form the angle $2\alpha$ with each other. Therefore, the direction of the magnetic flux within the gap 105 does not take the same direction as that of the magnetic flux within the gap 106. Thus, the magnetic flux within the gap 105 is completely separated from that within the gap 106.

Between the branched portions 104*a* and 104*b* of the rear yoke 104 is formed an opening 107 so that the below-mentioned stylus sub-assembly consisting of a stylus 109, a cantilever 103, moving coils 113, 114, etc. may be received between the branched portions. The stylus sub-assembly including a supporting portion 110 and a fulcrum can be detached from the yokes and the moving coils will be arranged at places where they are to interlink the magnetic fluxes of the gaps. The width $W_1$ of the opening portion 107 is made wider than the width between a pair of the moving coils 113 and 114 of the stylus assembly, so that it can be easily disposed within the opening 107. The opening 107 continues to the gaps 105, 106 respectively. Thereby, the moving coils can be introduced into the gaps 105 and 106 without contacting them with the yokes 102 and 104. The permanent magnet 101, the front yoke 102 and the rear yoke 104 are assembled within the cartridge body excluding the gaps 105, 106 of the opening 107.

Figure 11:
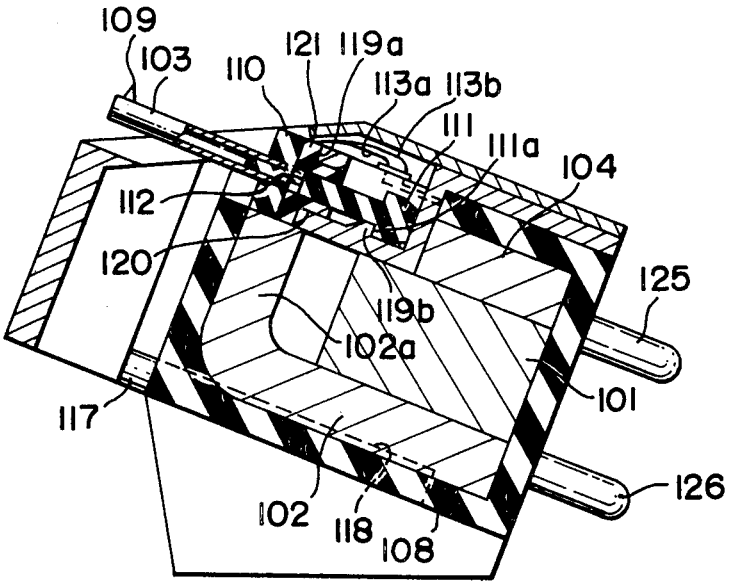
FIG. 11 is a sectional view of the embodiment in FIG. 8 assembled to a cartridge body.
Figure 12:
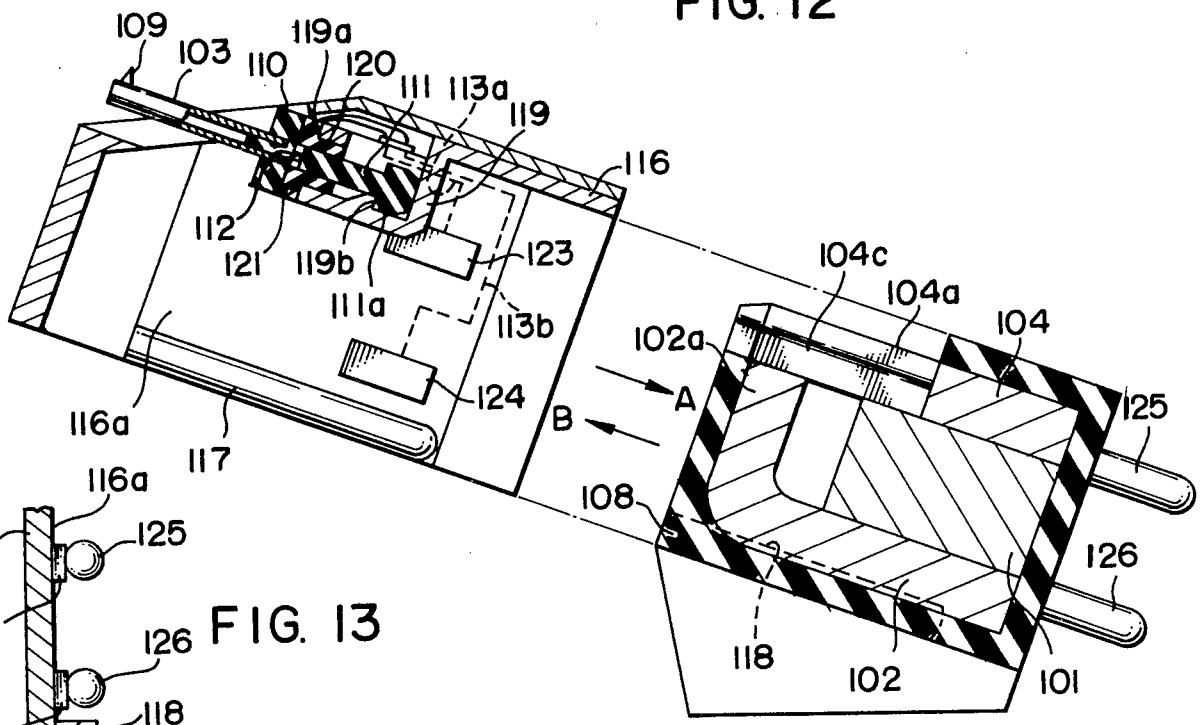
FIG. 12 is a partial section view of the embodiment in FIG. 8 in a state in which the embodiment in FIG. 8 is detached from the cartridge body.
Figure 13:
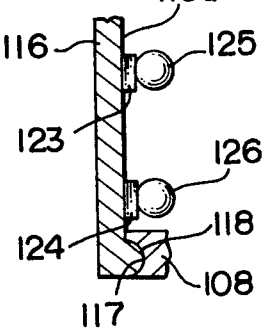
FIG. 13 is a partial view of the contact portion in which terminal pins are in contact with contactors.

As illustrated more completely in FIGS. 11-13, on the tip of the cantilever 103 is mounted the stylus 109 and to the base of the cantilever is attached the supporting portion 110. A fitting member 111 extends rearward from the rear end of the supporting portion. The fulcrum 112 reduced in diameter is provided between the fitting member 111 and the supporting portion 110. The supporting portion 110, the fulcrum 112 and the fitting member may be integrally made in a known manner of synthetic resin such as polypropylene, or the fulcrum 112 may be made of thin wire. To the supporting portion 110 are attached the moving coils 113 and 114 with each coil-wound direction being identical with an axial direction of the cantilever 103. The moving coils 113 and 114 interlink the magnetic flux of the gaps 105 and 106, thereby generating electrical signals in the coils 113, 114. The moving coils are wound around the coil bobbins 115 made of magnetic material or non-magnetic material and attached to the supporting portion 110. The width $W_2$ of the moving coils 113 and 114 is smaller than the width $W_1$ of the opening portion 107 of the yoke 4 and thereby the vibrating portion is insertable through the opening portion 107. 116 is a knob which is attachable to or detachable from the cartridge body 108.

A projection 117 extending in a transverse direction of the knob 116 is provided at the base of the knob 116 while a recess 118 is provided at the base of the cartridge body. The knob 116 is assembled to the cartridge body 108 through moving the knob in a direction of A—arrow in FIG. 12 and fitting the projection 117 into the recess 118. In this embodiment, the projection 117 and the recess 118 are provided in a transverse direction of the knob 116 and the cartridge body 108 respectively. Meanwhile, in FIG. 12, the knob 116 may be insertable from the upper side of the cartridge body 108 so that the stylus sub-assembly may be detachable from the upper side of the cartridge body 108.

The fitting portion 119 is provided inside of the knob 116 and the fitting member 111 passed through the through hole 120 of the fitting portion 119 as opposed to the fitting portion 119.

A damper 121 is inserted between the front plane 119*a* of the fitting portion 119 and the supporting portion 110. The damper 121 is pressed so that the shoulder 111*a* of the fitting member 111 may be hooked to the projection 119*b* of the fitting portion 119 for giving the rearward tension to the fulcrum 112.

At the inner wall 116*a* of the knob 116 are provided contactors 123 and 124 at which the starting end 113*a* and the ending end 113*b* of the wound coil 113 are connected respectively. The contactors (not shown) for connecting the starting end 114*a* and the ending end 114*b* of the coil 114 respectively are also provided at the inner wall 116*a* of the knob 116. When the knob 116 is assembled to the cartridge body 108, as shown in FIG. 13, the contactors 123 and 124 are in contact with the terminal pins 125 and 126 respectively attached to the cartridge body 108, so that the contactors and the terminal pins are electrically connected.

The contactors (not shown) for connecting the starting end 114*a* and the ending end 114*b* of the coil 114 are also connected to the terminal pins (not shown) of the cartridge body 108 respectively.

In this embodiment, when integral assembling is effected through moving the knob in a direction of A—arrow in FIG. 12 and fitting the projection 117 of the knob 116 into the recess 118 of the cartridge body 108, the stylus sub-assembly consisting of the stylus 109, the cantilever 103, the moving coils 113, 114, etc., is arranged within the opening 107 so that it may not be in contact with the portion 102*a* of the front yoke 102 and the branched ends 104*a*, 104*b* of the rear yoke 104. At the same time, the moving coils 113 and 114 are arranged at a place (within the gaps 105 and 106) where they interlink the magnetic fluxes of the gaps 105, 106 respectively through the opening 107 and the terminal pins 125 and 126 are connected to the contactors 123 and 124 electrically.

Contrarily, when the knob 116 is moved in a direction of arrow B, the contacting state of the terminal pins 125, 126 and the contactors 123, 124 are released and the knob 116 to which the above-mentioned vibrating portion is attached is taken off from the cartridge body 108. At this time, the moving coils 113 and 114 as well as the supporting portion 110, the fulcrum 112, the fitting member 111 and the cantilever 103 are detached through the opening 107 from the cartridge body 108.

As mentioned above, in this embodiment, the front yoke is arranged within the imaginary plane perpendicularly intersecting the cantilever. A pair of the branched ends of the rear yoke extend along the axial direction of the cantilever toward the portion 102*a* of the front yoke and the opening is provided between the branched ends of the rear yoke.

The coil-wound direction of each moving coil is made the same as the axial direction of the cantilever. Therefore, each coil is insertable into place with the corresponding gap to interlink the magnetic flux with no interruption of the yokes, thereby resulting in a simple structure for stylus-exchange and simple manipulation thereof.

What is claimed is:

1. A moving coil type stereophonic pickup cartridge comprising:

(a) a cantilever which has a stylus mounted on a front end thereof, (b) a front yoke which is arranged within an imaginary plane intersecting the axis of the cantilever, (c) a rear yoke having a pair of branched portions which extend toward the front yoke parallel to the axis of the cantilever, (d) a magnet for magnetizing the front yoke and the rear yoke, (e) a pair of magnetic gaps which are formed within the front yoke, the rear yoke, and the branched portions of the rear yoke and are arranged at the right and left of the cantilever at such an angle that the directions of the magnetic flux in the magnetic gaps correspond to the groove wall of a 45/45 system record, (f) a pair of coil bobbins attached to a supporting portion of the cantilever, one of said coil bobbins extending therefrom at an angle of substantially 45° from an imaginary vertical plane coinciding with the axis of the cantilever and the other of said coil bobbins being arranged symmetrically on the opposite side of said imaginary vertical plane, each of said coil bobbins comprising a first portion attached to the cantilever supporting portion and extending therefrom toward said magnet at the angle of 45° and a second portion formed integrally with said first portion and extending therefrom substantially parallel to the axis of the cantilever, and (g) a moving coil wound only on each of said second portions of the coil bobbins and the moving coil-wound portions positioned and disposed as a whole within said air gaps, the axial directions of which are approximately parallel to the axial direction of the cantilever, whereby stereophonic reproduction is effected for a stereophonic record of the 45/45 system.

2. The pickup cartridge according to claim 1, wherein said coil bobbins are made of a high permeability material.

3. The pickup cartridge according to claim 1, wherein said coil bobbins are formed integrally with a supporting portion at a base part of said cantilever, cavities are formed in said coil bobbins, and members of a high permeability material are inserted in said cavities.

4. The pickup cartridge according to claim 3, wherein a damper is formed with a pair of protrusions, and said protrusions are disposed between two branch parts of a fore end of a rear yoke and said coil bobbins inside said gaps.

5. The pickup cartridge according to claim 1, further comprising a flexible tension wire extending axially rearwardly from a supporting portion on said cantilever on which a pair of coil bobbins are mounted, a supporter mounted on the end of said tension wire remote from said supporting portion, said tension wire being free to bend between said supporter and said supporting portion.

6. The pickup cartridge according to claim 5, wherein said tension wire is formed of resin by integrally molding it with said supporting portion.

7. The pickup cartridge according to claim 1, wherein said front yoke and said rear yoke are formed of a high permeability material, said front yoke and said rear yoke are mounted before and behind a magnet, said gaps are formed between said front yoke and said rear yoke, a fore end of said front yoke is formed into a protuberant part which includes two edges which intersect orthogonally, a fore end of said rear yoke is formed into two branched ends, and the two branched ends are made parallel to said two edges of said protuberant part of said front yoke.

8. The pickup cartridge according to claim 1 wherein the front yoke and the magnet are fixed to a main body, the rear yoke is fixed to a stylus knob, and a terminal plate and subterminal means are further mounted on said stylus knob, the leads of said pair of moving coils are connected to said subterminal means.

9. A moving coil type stereophonic pickup cartridge comprising:

(1) a cantilever sub-assembly comprising:
- (i) a stylus,
- (ii) a cantilever arm carrying said stylus,
- (iii) a supporting portion supporting said cantilever arm,
- (iv) a pair of coil bobbins attached to said supporting portion one of said coil bobbins extending therefrom at an angle of substantially 45° from an imaginary vertical plane coinciding with the axis of the cantilever arm and the other of said coil bobbins being arranged symmetrically on the opposite side of the imaginary vertical plane, each of said coil bobbins comprising a first portion attached to said supporting portion and extending therefrom in the direction opposite to the stylus at the angle of 45° and a second portion formed integrally with said first portion and extending therefrom substantially parallel to the axis of the cantilever arm, and
- (v) a moving coil wound only on each of said second portions of the coil bobbins and the moving coil wound portions positioned and disposed as a whole within said magnetic gaps, the axial directions of which are approximately parallel to the axial direction of the cantilever arm, (2) a stylus knob sub-assembly comprising:
- (i) a front edge portion mounting said cantilever sub-assembly,
- (ii) a subterminal means connected electrically to said moving coils of said cantilever sub-assembly,
- (iii) a terminal plate connected electrically to said subterminal means to form an integral circuit among said cantilever sub-assembly said subterminal means and said terminal plate, and
- (iv) a rear yoke having a pair of branched portions extending toward the stylus and parallel to the axis of the cantilever arm, (3) a cartridge body detachable from said stylus knob sub-assembly comprising:
- (i) a magnet,
- (ii) a front yoke connected magnetically to said magnet, said front yoke being capable of being fitted to said stylus sub-assembly and disposed below the moving coil-wound portions, and
- (iii) a slot for fitting said rear yoke of said stylus knob sub-assembly, said slot being provided on the opposite side of the front yoke and allowing the surface of said rear yoke to come into contact with the rear side of said magnet, and (4) a pair of magnetic gaps which are formed, when assembled, within the front yoke, the rear yoke, and the branched portions of the rear yoke and are arranged at the right and left of the cantilever arm at such an angle that the directions of the magnetic flux in the magnetic gaps correspond to the groove wall of a 45/45 system record.

10. The pickup cartridge according to claim 9, further comprising a main body, a stylus knob detachably mounted on said main body, said stylus knob being provided with a protuberance in a groove which uniquely fixes a supporter of the cantilever with respect to the knob, a damper made of an elastic material disposed between a supporting portion of the cantilever and said stylus knob, said damper being compressed by applying a tension in a direction of a tension wire, said cantilever being supported on said stylus knob by a reaction force against the compression so that it may freely oscillate about its fulcrum relative to said stylus knob.

11. The moving coil type stereophonic pickup cartridge claimed in claim 9, further comprising contactors connected to the moving coils provided on the knob and contactors conected to terminal pins provided on the cartridge body so that the above-mentioned two kinds of contactors are connected or disconnected to each other by connecting or disconnecting the knob to the cartridge body.

* * * * *